US007958739B1

(12) United States Patent
Leabo

(10) Patent No.: US 7,958,739 B1
(45) Date of Patent: Jun. 14, 2011

(54) REFRIGERATION HOT GAS DESUPERHEATER SYSTEMS

(76) Inventor: Lawrence D. Leabo, Glendale, AZ (US)

( * ) Notice: Subject to any disclaimer, the term of this patent is extended or adjusted under 35 U.S.C. 154(b) by 0 days.

(21) Appl. No.: 12/909,018

(22) Filed: Oct. 21, 2010

Related U.S. Application Data

(63) Continuation-in-part of application No. 12/534,798, filed on Aug. 3, 2009, now Pat. No. 7,882,707.

(60) Provisional application No. 61/085,911, filed on Aug. 4, 2008, provisional application No. 61/114,880, filed on Nov. 14, 2008, provisional application No. 61/254,632, filed on Oct. 23, 2009.

(51) Int. Cl.
*F25B 1/00* (2006.01)

(52) U.S. Cl. ..... 62/115; 62/234; 62/510; 62/513

(58) Field of Classification Search ..... 62/115, 62/177, 238.7, 228.3, 324.1, 500, 510, 513, 62/80, 151, 234, 515; 165/174, 175, 178
See application file for complete search history.

(56) References Cited

U.S. PATENT DOCUMENTS

| | | | | |
|---|---|---|---|---|
| 3,645,109 | A * | 2/1972 | Quick | 62/196.2 |
| 3,766,745 | A * | 10/1973 | Quick | 62/196.2 |
| 4,492,092 | A * | 1/1985 | Smorol et al. | 62/181 |
| 4,550,574 | A * | 11/1985 | Hohman | 62/197 |
| 5,041,246 | A | 8/1991 | Garrison | |
| 5,097,677 | A | 3/1992 | Holtzapple | |
| 5,613,372 | A * | 3/1997 | Beal et al. | 62/434 |
| 5,630,913 | A * | 5/1997 | Tajer-Ardebili | 202/176 |
| 5,692,387 | A * | 12/1997 | Alsenz et al. | 62/184 |
| 6,189,329 | B1 * | 2/2001 | Peterson | 62/335 |
| 6,467,303 | B2 | 10/2002 | Ross | |
| 6,739,139 | B1 * | 5/2004 | Solomon | 62/6 |
| 6,964,168 | B1 * | 11/2005 | Pierson et al. | 60/670 |
| 7,003,964 | B2 * | 2/2006 | Solomon | 62/6 |
| 2002/0029877 | A1 * | 3/2002 | Cowans | 165/206 |
| 2004/0237562 | A1 * | 12/2004 | Solomon | 62/324.1 |
| 2005/0066538 | A1 * | 3/2005 | Goldberg et al. | 34/218 |
| 2005/0262870 | A1 * | 12/2005 | Narayanamurthy et al. | 62/434 |
| 2006/0117783 | A1 * | 6/2006 | Solomon | 62/324.1 |
| 2006/0179676 | A1 * | 8/2006 | Goldberg et al. | 34/77 |
| 2007/0095093 | A1 * | 5/2007 | Narayanamurthy | 62/434 |
| 2008/0028776 | A1 * | 2/2008 | O'Brien et al. | 62/93 |

FOREIGN PATENT DOCUMENTS

| | | | |
|---|---|---|---|
| JP | 06194008 | A | 7/1994 |
| JP | 07158986 | A | 6/1995 |
| JP | 2003004315 | A | 1/2003 |
| JP | 2006003071 | A | 1/2006 |

* cited by examiner

*Primary Examiner* — Mohammad Ali
(74) *Attorney, Agent, or Firm* — Stoneman Law Patent Group; Martin L. Stoneman

(57) ABSTRACT

A system for desuperheating hot gaseous refrigerant using both a heat exchanger and a dispersed Venturi-driven injection of liquid refrigerant is disclosed. Further, a system, relating to cooling at least one compressed superheated refrigerant fluid prior to condensing, relating to extending the life of at least one condenser is disclosed.

53 Claims, 8 Drawing Sheets

REFRIGERATION HOT GAS DESUPERHEATER SYSTEMS

CROSS REFERENCE TO RELATED APPLICATION

The present application is a continuation-in-part and is related to prior U.S. non-provisional application Ser. No. 12/534,798, filed Aug. 3, 2009, entitled "REFRIGERATION HOT GAS DESUPERHEATER SYSTEMS", which application is related to and claims priority from prior U.S. provisional application Ser. No. 61/085,911, filed Aug. 4, 2008, entitled "REFRIGERATION HOT GAS DESUPERHEATER SYSTEMS", and which application is also related to and claims priority from prior U.S. provisional application Ser. No. 61/114,880, filed Nov. 14, 2008, entitled "REFRIGERATION HOT GAS DESUPERHEATER SYSTEMS", and is also related to and claims priority from prior U.S. provisional application Ser. No. 61/254,632, filed Oct. 23, 2009, entitled "REFRIGERATION HOT GAS DESUPERHEATER SYSTEMS", the contents all of which are incorporated herein by this reference and are not admitted to be prior art with respect to the present invention by the mention in this cross-reference section.

BACKGROUND

This invention relates to providing a system for improved refrigeration hot-gas desuperheating. More particularly, this invention relates to providing a system for desuperheating hot gaseous refrigerant using an injection of liquid refrigerant.

Mechanical refrigeration is typically accomplished by circulating, evaporating, and condensing a supply of chemical refrigerant in a continuous thermodynamic cycle. In a typical refrigeration cycle, low pressure vapor refrigerant is compressed by a mechanical compressor and discharged as a pressure superheated vapor. The high pressure refrigerant flows to the condenser by way of a "discharge line". The condenser is used to change the high pressure refrigerant from a high temperature vapor to a lower temperature liquid that exits the condenser through a "liquid runoff line". The liquid refrigerant then flows to a thermal expansion valve where the high pressure liquid is changed to a low-pressure, low-temperature vapor. The low-pressure, low-temperature vapor enters the evaporator where a useful heat exchange typically occurs. The low pressure vapor is then returned to the mechanical compressor and the cycle then repeats.

The chemical refrigerant absorbs heat at several points in the refrigeration cycle. Heat is initially absorbed in the evaporator. Further, heat is absorbed by the refrigerant during the compression, such that superheated gaseous refrigerant is discharged from the compressor to the discharge line.

Superheating is a major drawback in refrigeration systems utilizing commercial water-cooled condensers in that passage of the superheated gas through such a condenser can result in the development of detrimental scale deposits (scaling) on the heat-exchanging surfaces. The water used in these condensers typically contains traces of calcium bicarbonate and other dissolved salts that can form water-insoluble deposits when exposed to excessive heat. It would be useful to provide a means for desuperheating of the gaseous refrigerant prior to condensing would reduce such scaling through a proportional reduction of water temperature. Such a method might beneficially extend the time the condenser may operate without maintenance (de-scaling of the coils, coil replacement, etc.), and may further benefit operation by reducing the amount of scale-inhibiting chemicals that must be added to such systems.

It is clear from the above discussion that improved methods of desuperheating gaseous refrigerant prior to movement through such condensers would be of benefit to those whose commerce is dependent on such mechanical systems.

OBJECTS AND FEATURES OF THE INVENTION

A primary object and feature of the present invention is to provide a system addressing the above-described problems.

It is a further object and feature of the present invention to provide such a system comprising at least one fitting adapted to desuperheat refrigerant gas by mixing superheated gas refrigerant with a cooler liquid refrigerant.

It is a further object and feature of the present invention to provide a system comprising at least one fitting adapted to desuperheat refrigerant gas through a multistage process, with at least one heat exchange and at least one injection.

Another object and feature of the present invention is to provide a system adaptable to a range of "discharge line" sizes.

A further object and feature of the present invention is to provide a system with passive drawing of liquid refrigerant to inject into superheated gas refrigerant.

Yet another object and feature of the present invention is to provide a system designed to be able to operate level with the condenser of a refrigeration cycle.

It is a further object and feature of the present invention to provide a system using the "Venturi Effect" to passively suction liquid refrigerant to inject into superheated gas refrigerant.

A further object and feature of the present invention is to provide such a system, which, when used, may extend the life of at least one water cooled condenser in a refrigeration cycle through assisting prevention of "flash vaporization" of water in such water cooled condenser.

Another object and feature of the present invention is to provide such a system, which can also be used in the defrost cycle of a refrigeration cycle to extend the life of at least one evaporator in such refrigeration cycle by assisting prevention of excessive thermal shock.

Yet another object and feature of the present invention is to provide such a system, which can be used to reintroduce refrigerant from a temporary holding tank.

A further object and feature of the present invention is to provide such a system that reintroduces refrigerant at a rate of about 40 lb per minute.

Another object and feature of the present invention is to provide such a system, which uses an air cooled condenser.

Yet another object and feature of the present invention is to provide such a system, which may be used in residential air conditioning units.

Yet a further object and feature of the present invention is to provide such a system, which may be used to retrofit residential air conditioning units.

A further object and feature of the present invention is to provide such a system that is used with a commercial compressor stack.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system, relating to cooling at least one superheated refrigerant fluid during at least one heat cycle, such system comprising: at least one heat exchanger structured and arranged to exchange heat between at least one cooling fluid and the at least one superheated refrigerant fluid to decrease temperature differential between such at least one cooling fluid and such at least one superheated refrigerant fluid; at least one injector, structured and arranged to inject such at least one cooling fluid into the at least one superheated refrigerant fluid after exchange of heat in such at least one heat exchanger; and at least one fluid mixer structured and arranged to mix such injected cooling fluid and the at least one superheated refrigerant fluid to produce at least one desuperheated refrigerant fluid having at least one state substantially near at least one saturated state; wherein such at least one heat exchanger comprises at least one suction creator structured and arranged to create suction to draw such at least one cooling fluid into such at least one heat exchanger by decreasing localized pressure near such at least one injector; and wherein such at least one suction creator assists injection by such at least one injector.

Moreover, it provides such a system wherein such at least one suction creator comprises at least one separator structured and arranged to physically separate such at least one cooling fluid from the at least one superheated refrigerant fluid, while allowing exchange of heat in such at least one heat exchanger by transmitting heat through such at least one separator. Additionally, it provides such a system wherein such at least one suction creator comprises at least one tube. Also, it provides such a system wherein such at least one tube is structured and arranged to: contain flow of the at least one superheated refrigerant fluid inside such at least one tube; and separate flow of such at least one cooling fluid substantially around at least one perimeter of such at least one tube.

In addition, it provides such a system wherein such at least one injector is structured and arranged to inject such at least one cooling fluid into the at least one superheated refrigerant fluid substantially evenly around at least one perimeter of flow of the at least one superheated refrigerant fluid. And, it provides such a system wherein such at least one injector comprises at least one injector port. Further, it provides such a system wherein such at least one injector comprises a plurality of such at least one injector ports evenly spaced about the perimeter of the flow of the at least one superheated refrigerant fluid. Even further, it provides such a system wherein: when connected to at least one discharge line, the diameter of such at least one injector port multiplied by the quantity of such plurality of such at least one injection ports comprises about the diameter of at least one discharge line. Moreover, it provides such a system wherein the diameter of such at least one injector port comprises between about ⅛ inch and about ½ inch. Additionally, it provides such a system wherein the diameter of such at least one injector port comprises about ⅜ inch.

Also, it provides such a system wherein the diameter of such at least one injector port comprises about ¼ inch. In addition, it provides such a system further comprising at least one outer container structured and arranged to contain such at least one cooling fluid substantially near such at least one separator. And, it provides such a system further comprising at least one discharge line structured and arranged to fit at least one discharge line. Further, it provides such a system wherein such at least one suction creator is substantially cylindrical. Even further, it provides such a system wherein such at least one outer container is substantially cylindrical. Moreover, it provides such a system wherein the difference between the diameter of such at least one discharge line and the diameter of such at least one suction creator comprises between about ½ inch and about ¼ inch.

Additionally, it provides such a system wherein the difference between the diameter of such at least one outer container and the diameter of such at least one suction creator comprises between about 2 inches and about 1 inch. Also, it provides such a system wherein the diameter of such at least one outer container comprises about 2⅝ inches. In addition, it provides such a system wherein the diameter of such at least one discharge line comprises about ⅞ inches. And, it provides such a system wherein the diameter of such at least one suction creator comprises about ⅝ inches. Further, it provides such a system wherein the diameter of such at least one discharge line comprises about 1⅛ inches. Even further, it provides such a system wherein the diameter of such at least one suction creator comprises about ⅞ inches. Moreover, it provides such a system wherein the diameter of such at least one discharge line comprises about 1⅜ inches. Additionally, it provides such a system wherein the diameter of such at least one suction creator comprises about 1⅛ inches. Also, it provides such a system wherein the diameter of such at least one outer container comprises about 3⅛ inches. In addition, it provides such a system wherein the diameter of such at least one discharge line comprises about 1⅝ inches. And, it provides such a system wherein the diameter of such at least one suction creator comprises about 1⅜ inches.

Further, it provides such a system wherein the diameter of such at least one discharge line comprises about 2⅛ inches. Even further, it provides such a system wherein the diameter of such at least one suction creator comprises about 1⅝ inches. Moreover, it provides such a system wherein the diameter of such at least one discharge line comprises about 2⅝ inches. Additionally, it provides such a system wherein the diameter of such at least one suction creator comprises about 2⅛ inches. Also, it provides such a system wherein the diameter of such at least one outer container comprises about 3⅝ inches. In addition, it provides such a system wherein the diameter of such at least one discharge line comprises about 3⅛ inches. And, it provides such a system wherein the diameter of such at least one suction creator comprises about 2⅝ inches. Further, it provides such a system wherein such at least one injector comprises metal.

Even further, it provides such a system wherein such at least one injector comprises brass. Even further, it provides such a system wherein such at least one injector comprises copper. Even further, it provides such a system wherein such at least one heat exchanger comprises metal. Even further, it provides such a system wherein such at least one heat exchanger comprises copper.

Moreover, it provides such a system further comprising: at least one compressor; at least one evaporator; and at least one condenser; wherein such at least one injector is located between such at least one compressor and such at least one condenser. Additionally, it provides such a system wherein such at least one condenser is water-cooled. Also, it provides such a system wherein such at least one condenser is air-cooled. In addition, it provides such a system wherein such at least one compressor, such at least one evaporator and such at least one condenser comprises at least one heat pump. And, it provides such a system further comprising a plurality of parallel compressors. Further, it provides such a system further comprising a plurality of evaporators.

In accordance with another preferred embodiment hereof, this invention provides a system, relating to handling pressure changes of at least one refrigerant in a heat cycle circuit, comprising at least one compressor structured and arranged to assist compressing of the at least one refrigerant; at least one evaporator structured and arranged to assist heat-collection by the at least one refrigerant; at least one condenser structured and arranged to assist heat-rejection from the at least one refrigerant; at least one refrigerant reserve storer structured and arranged to assist collecting excess portions of the at least one refrigerant out of the heat cycle circuit, relieving excess pressure, when pressure of the at least one refrigerant increases due to a defrost cycle; and at least one refrigerant re-injector structured and arranged to assist re-injection of such excess portions of the at least one refrigerant from such at least one refrigerant reserve storer back into the heat cycle circuit, when pressure of the at least one refrigerant decreases after a defrost cycle; wherein such at least one refrigerant injector is located between such at least one compressor and such at least one condenser.

Even further, it provides such a system wherein such at least one refrigerant injector assists injection of the at least one refrigerant from such at least one refrigerant reserve storer at a rate from about 1 lb per minute to about 100 lb per minute. Even further, it provides such a system wherein such at least one refrigerant injector assists injection of the at least one refrigerant from such at least one refrigerant reserve storer at a rate of about 40 lb per minute.

Even further, it provides such a system wherein such at least one refrigerant injector comprises: at least one heat exchanger structured and arranged to exchange heat between the at least one refrigerant coming from such at least one refrigerant reserve storer and the at least one refrigerant in the heat cycle circuit to decrease temperature differential between the at least one refrigerant coming from such at least one refrigerant reserve storer and the at least one refrigerant in the heat cycle circuit; at least one injector, structured and arranged to inject the at least one refrigerant coming from such at least one refrigerant reserve storer into the at least one refrigerant in the heat cycle circuit after exchange of heat in such at least one heat exchanger; and at least one fluid mixer structured and arranged to mix the at least one refrigerant coming from such at least one refrigerant reserve storer and the at least one refrigerant in the heat cycle circuit to produce at least one thermally-mixed refrigerant fluid; wherein such at least one heat exchanger comprises at least one suction creator structured and arranged to create suction to draw the at least one refrigerant coming from such at least one refrigerant reserve storer into such at least one heat exchanger by decreasing localized pressure near such at least one injector, and wherein such at least one suction creator assists injection by such at least one injector.

Even further, it provides such a system wherein such at least one refrigerant injector assists injection of the at least one refrigerant from such at least one refrigerant reserve storer at a rate from about 1 lb per minute to about 100 lb per minute. Even further, it provides such a system wherein such at least one refrigerant injector assists injection of the at least one refrigerant from such at least one refrigerant reserve storer at a rate of about 40 lb per minute.

In accordance with another preferred embodiment hereof, this invention provides a method, relating to cooling at least one superheated refrigerant fluid during at least one heat cycle, such method comprising the steps of: exchanging heat, in at least one heat exchanger, between at least one cooling fluid and the at least one superheated refrigerant fluid to decrease temperature differential between such at least one cooling fluid and the at least one superheated refrigerant fluid; injecting, using at least one injector, such at least one cooling fluid into the at least one superheated refrigerant fluid after the step of exchanging heat; mixing such injected cooling fluid and the at least one superheated refrigerant fluid to produce at least one desuperheated refrigerant fluid having at least one state substantially near at least one saturated state; and creating suction to draw such at least one cooling fluid into such at least one heat exchanger by decreasing localized pressure near such at least one injector; wherein such suction assists injection by such at least one injector.

In accordance with another preferred embodiment hereof, this invention provides a system, relating to cooling at least one superheated refrigerant during at least one heat cycle, such system comprising: heat exchanger means for exchanging heat between at least one cooling fluid and the at least one superheated refrigerant fluid to decrease temperature differential between such at least one cooling fluid and the at least one superheated refrigerant fluid; injector means for injecting such at least one cooling fluid into the at least one superheated refrigerant fluid after exchange of heat in such at least one heat exchanger; fluid mixer means for mixing such injected cooling fluid and the at least one superheated refrigerant fluid to produce at least one desuperheated refrigerant fluid having at least one state substantially near at least one saturated state; wherein such heat exchanger means comprises suction creator means for creating suction to draw such at least one cooling fluid into such heat exchanger means by decreasing localized pressure near such injector means; and wherein such suction creator means assists injection by such injector means.

In accordance with another preferred embodiment hereof, this invention provides a method, relating to cooling at least one superheated refrigerant batch during at least one heat cycle, such method comprising the steps of: creating suction to draw at least one cooler refrigerant batch into heat exchange relationship with such at least one superheated refrigerant batch; exchanging heat between such at least one superheated refrigerant batch and at least one cooler refrigerant batch to decrease temperature differential between such at least one superheated refrigerant batch and such at least one cooler refrigerant batch and form at least one cooler superheated refrigerant batch; injecting such at least one cooler refrigerant batch into the at least one cooler superheated refrigerant batch after the step of exchanging heat; and mixing such at least one cooler refrigerant batch and such at least one cooler superheated refrigerant batch to produce at least one desuperheated refrigerant batch having at least one portion substantially near at least one saturated state.

And it provides for each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
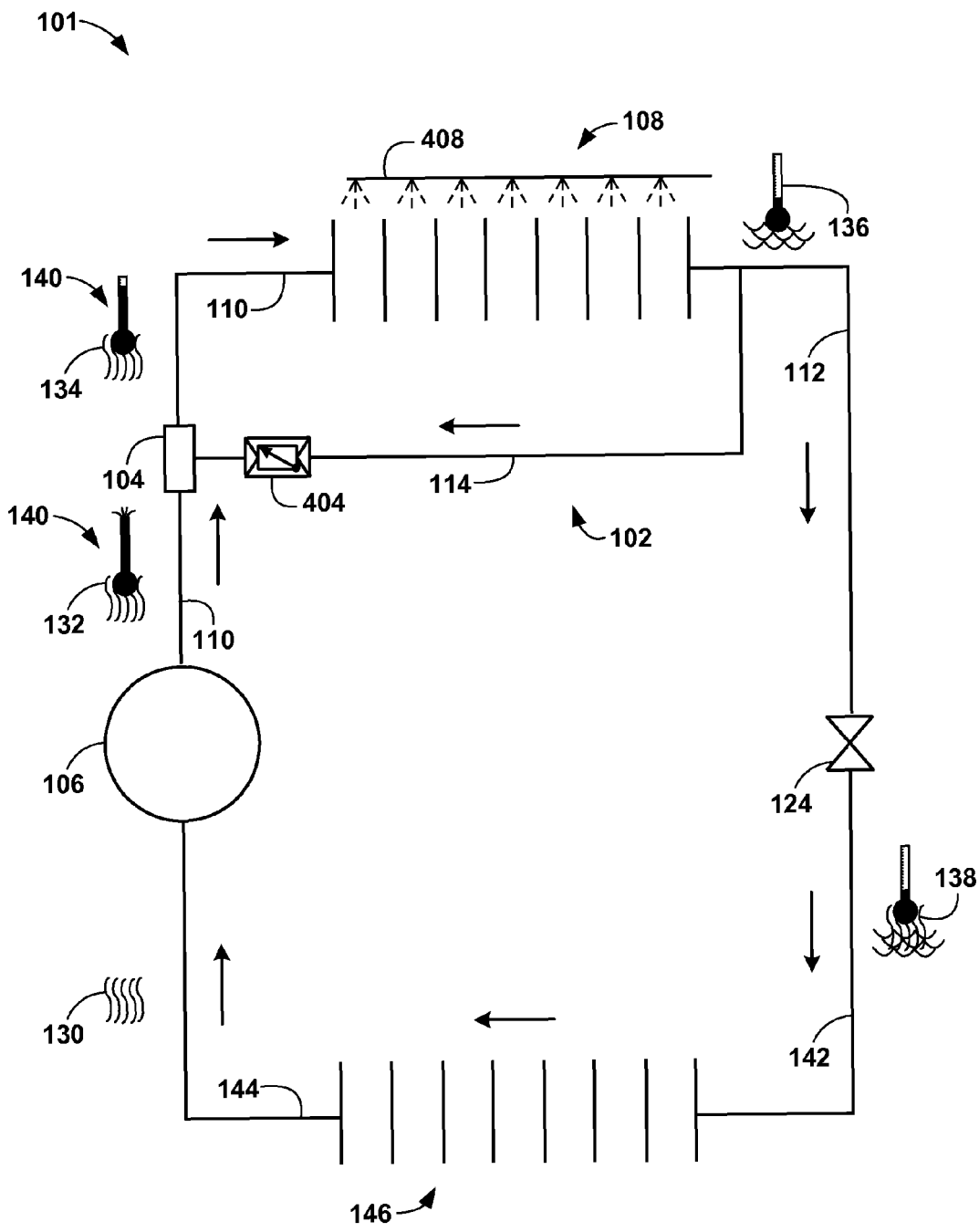
FIG. 1 shows a schematic diagram, illustrating the primary components of a refrigeration cycle utilizing at least one hot-gas desuperheater circuit, according to a preferred embodiment of the present invention.

FIG. 1 shows a schematic diagram, illustrating the primary components of a refrigeration cycle 101 at least one utilizing hot-gas desuperheater circuit 102, according to a preferred embodiment of the present invention.

In refrigeration cycle 101, depicted in FIG. 1, at least one mechanical compressor 106 preferably compresses low-pressure vapor refrigerant 130, preferably to form a high-temperature vapor 140, which preferably discharges into at least one discharge line 110. High-temperature vapor 140 enters discharge line 110 superheated as high-temperature superheated vapor 132, as shown. Discharge line 110 preferably transports high-temperature vapor 140 to at least one condenser 108, as shown.

Condenser 108 preferably comprises at least one water-cooled condenser 408 (at least herein embodying wherein said at least one condenser is water-cooled). Upon reading the teachings of this specification, those skilled in the art will now appreciate that, under appropriate circumstances, considering such issues as future technology, cost, etc., other condensers, such as, for example, thermo-electric condensers, thermal well condensers, passive condensers, etc., may suffice.

Condenser 108 preferably condenses high-temperature vapor 140 to form a lower-temperature liquid 136 that preferably exits condenser 108 through at least one liquid runoff line 112, as shown. Liquid runoff line 112 preferably transports lower-temperature liquid 136 to expansion valve 124, as shown.

Expansion valve 124 preferably rapidly lowers the pressure in liquid runoff line 112, preferably causing a portion of lower-temperature liquid 136 to vaporize, preferably forming a mixed vapor/liquid refrigerant 138, as shown. At least one evaporator feed line 142 preferably carries mixed vapor/liquid refrigerant 138 to at least one evaporator 146, as shown.

Evaporator 146 preferably vaporizes the remaining liquid in mixed vapor/liquid refrigerant 138, preferably through the transfer of heat, preferably from the environment around evaporator 146, to mixed vapor/liquid refrigerant 138, preferably forming low-pressure vapor refrigerant 130, as shown. At least one suction line 144 preferably transports low-pressure vapor refrigerant 130 to mechanical compressor 106 where refrigeration cycle 101 may repeat, as shown.

Refrigerant, cycled through refrigeration cycle 101 (low-pressure vapor refrigerant 130, high-temperature vapor 140, lower-temperature liquid 136, and mixed vapor/liquid refrigerant 138.), preferably comprises Freon. Upon reading this specification, those skilled in the art will now appreciate that, under appropriate circumstances, considering such issues as cost, future industry regulations, future technology, etc., other refrigerants, such as, for example, water, glycol, coolant mixtures, etc., may suffice.

Hot-gas desuperheater circuit 102 is preferably added to refrigeration cycle 101 to desuperheat high-temperature vapor 140, preferably forming high-temperature desuperheated vapor 134, preferably prior to entering condenser 108, as shown. More specifically, at least one liquid refrigerant transfer line 114 preferably connects between liquid runoff line 112 and discharge line 110, preferably to divert a portion of lower-temperature liquid 136, exiting condenser 108, to discharge line 110, as shown. Hot-gas desuperheater circuit 102 preferably comprises to at least one check valve 404, as shown, in liquid refrigerant transfer line 114, preferably to prevent backflow of high-temperature vapor 140 into liquid refrigerant transfer line 114.

Hot-gas desuperheater circuit 102 preferably comprises hot-gas desuperheater fitting 104 in fluid communication with liquid runoff line 112 by means of liquid refrigerant transfer line 114, as shown. Hot-gas desuperheater fitting 104 is preferably cut into discharge line 110 between mechanical compressor 106 and condenser 108 (at least herein embodying wherein said at least one injector is located between said at least one compressor and said at least one condenser), as shown. Liquid refrigerant transfer line 114 preferably couples to liquid runoff line 112 at a point preferably between condenser 108 and thermal expansion valve 124, preferably at an elevation between about level with, to about 24 inches above, hot-gas desuperheater fitting 104, preferably between about 12 inches and about 24 inches above hot-gas desuperheater fitting 104. The above described method embodies herein a method, relating to cooling at least one superheated refrigerant batch during at least one heat cycle, such method comprising the steps of: creating suction to draw at least one cooler refrigerant batch into heat exchange relationship with such at least one superheated refrigerant batch; exchanging heat between such at least one superheated refrigerant batch and at least one cooler refrigerant batch to decrease temperature differential between such at least one superheated refrigerant batch and such at least one cooler refrigerant batch and form at least one cooler superheated refrigerant batch; injecting such at least one cooler refrigerant batch into the at least one cooler superheated refrigerant batch after the step of exchanging heat; and mixing such at least one cooler refrigerant batch and such at least one cooler superheated refrigerant batch to produce at least one desuperheated refrigerant batch having at least one portion substantially near at least one saturated state. A batch being defined as a portion of the fluid as it flows through the refrigeration system.

Figure 2:
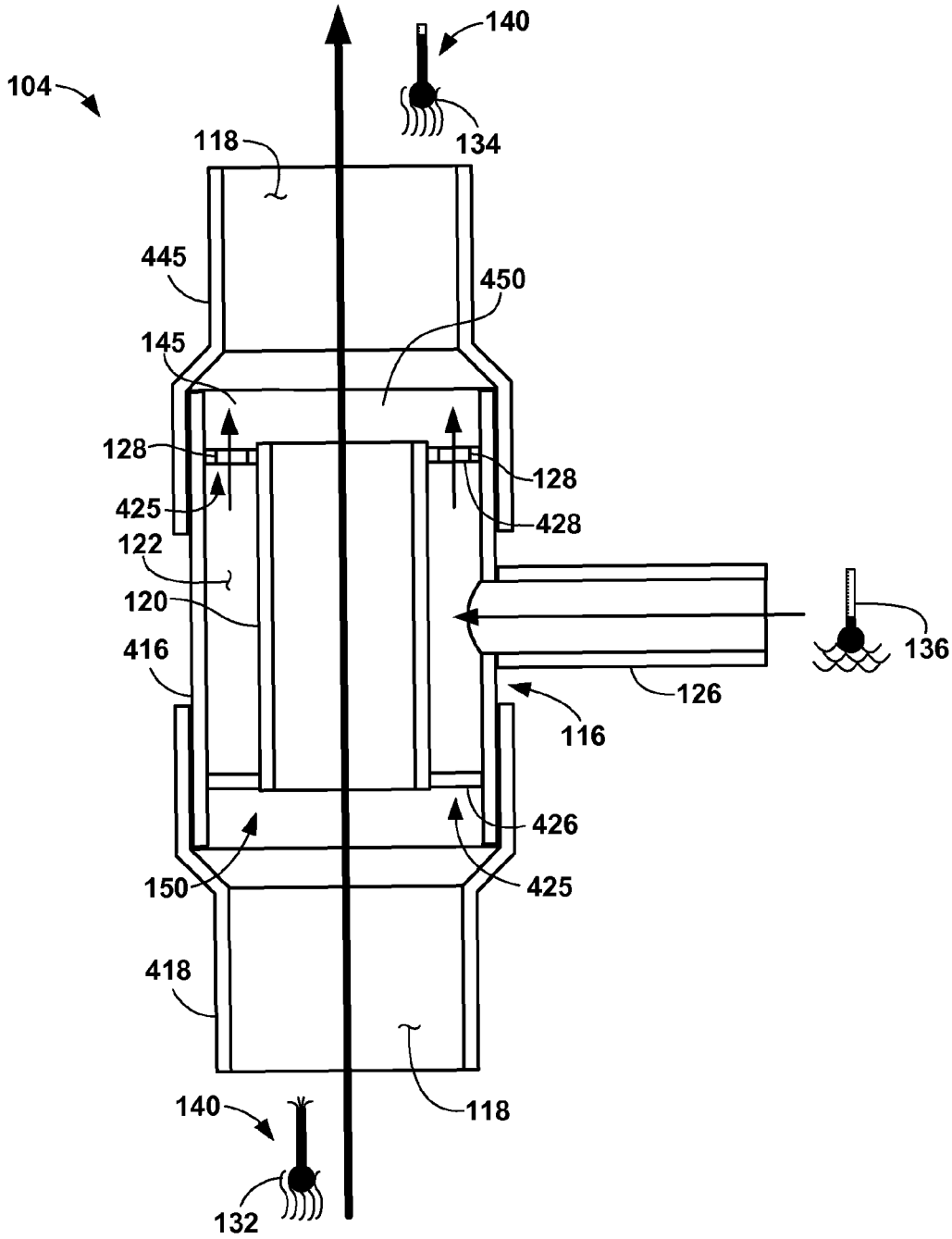
FIG. 2 shows a longitudinal cross-sectional view through the hot-gas desuperheater fitting, according to the preferred embodiment of FIG. 1.

FIG. 2 shows a longitudinal cross-sectional view through hot-gas desuperheater fitting 104 according to the preferred embodiment of FIG. 1.

Hot-gas desuperheater fitting 104 preferably comprises an outer conduit 116, preferably defining an interior passage 118 having an interior diameter, and preferably capable of coupling to refrigerant discharge line 110. Diameter of refrigerant discharge line 110 preferably comprises about ⅞ inch, alternately preferably about 1⅛ inch, alternately preferably about 1⅜ inch, alternately preferably about 1⅝ inch, alternately preferably about 2⅛ inch, alternately preferably about 2⅝ inch, alternately preferably about 3⅛ inch. Upon reading this specification, those skilled in the art will now appreciate that, under appropriate circumstances, considering such issues as future technology, size standards, regulations etc., other discharge line diameters, such as, for example, 5 cm, 7.5 cm, 3 inch, greater than 3⅛ inch, smaller than ⅞ inch, etc., may suffice.

Outer conduit 116 preferably comprises at least one outer housing 416, at least one intake-side coupler 418 and at least one outlet-side coupler 445, as shown. Intake-side coupler 418 and outlet-side coupler 445 preferably adapt diameter of outer housing 416 to refrigerant discharge line 110, as shown.

For diameters of refrigerant discharge line 110 ranging from about ⅞ inch to about 1⅜ inches, outer diameter of outer housing 416 preferably comprises about 2⅝ inches. For diameters of refrigerant discharge line 110 ranging from about 1⅜ inches to about 2⅝ inches, outer diameter of outer housing 416 preferably comprises about 3⅛ inches. For diameters of refrigerant discharge line 110 of about 3⅛ inches, outer diameter of outer housing 416 preferably comprises about 3⅝ inches. Upon reading this specification, those skilled in the art will now appreciate that, under appropriate circumstances, considering such issues as future technology, manufacturing methods, regulations etc., other outer housing diameter discharge line diameter pairings, such as, for example, ⅞ inch to 2⅛ inches, 1⅜ inches to 1⅞ inches, etc., may suffice.

Hot-gas desuperheater fitting 104 preferably comprises at least one Venturi structure 150, preferably comprising at least one interior channel 120, preferably comprising a diameter less than discharge line 110, preferably located within interior passage 118. Venturi structure 150 (at least herein embodying wherein said at least one heat exchanger comprises at least one suction creator structured and arranged to create suction to draw such at least one cooling fluid into said at least one heat exchanger by decreasing localized pressure near said at least one injector; and at least herein embodying wherein said heat exchanger means comprises suction creator means for creating suction to draw such at least one cooling fluid into heat exchanger means by decreasing localized pressure near said injector means), utilizing the "Venturi Effect", preferably induces the formation of at least one low-pressure region 145, preferably within interior passage 118, from the increased axial velocity of high-temperature superheated vapor 132 through interior channel 120.

Outer diameter of interior channel 120, as shown, preferably comprises between about ¼ inch less than refrigerant discharge line 110 (for smaller diameters of refrigerant discharge line 110) and preferably about ½ inch less than refrigerant discharge line 110 (for larger diameters of refrigerant discharge line 110). More particularly, for diameter of refrigerant discharge line 110 comprising about ⅞ inch, outer diameter of interior channel 120 preferably comprises about ⅝ inch. Additionally, for diameter of refrigerant discharge line 110 preferably comprising about 1⅛ inches, outer diameter of interior channel 120 preferably comprises about ⅞ inch. Further, for diameter of refrigerant discharge line 110 comprising about 1⅝ inches, outer diameter of interior channel 120 preferably comprises about 1⅜ inches. Even further, for diameter of refrigerant discharge line 110 comprising about 2⅛ inches, outer diameter of interior channel 120 preferably comprises about 1⅝ inches. Additionally, for diameter of refrigerant discharge line 110 comprising about 2⅝ inches, outer diameter of interior channel 120 preferably comprises about 2⅛ inches. Also, for diameter of refrigerant discharge line 110 comprising about 3⅛ inches, outer diameter of interior channel 120 preferably comprises about 2⅝ inches. Essentially, outer diameter of interior channel 120 preferably comprises about one standard size smaller than refrigerant discharge line 110 (this arrangement at least herein embodying wherein the diameter of such at least one discharge line is larger than the diameter of said at least one suction creator). Upon reading this specification, those skilled in the art will now appreciate that, under appropriate circumstances, considering such issues as standard sizing, flow requirements, etc., other size differentials between interior channel and discharge line may suffice.

Lower-temperature liquid refrigerant 136 preferably enters hot-gas desuperheater fitting 104 through at least one side inlet 126 in fluid communication with at least one internal pre-injection chamber 122, as shown. Side inlet 126 preferably receives lower-temperature liquid refrigerant 136 from liquid refrigerant transfer line 114 (see FIG. 1), as shown. Diameter of side inlet 126 preferably comprises about ⅞ inch.

Pre-injection chamber 122 is preferably positioned circumferentially around interior channel 120, preferably within interior passage 118, as shown. Pre-injection chamber 122 preferably runs the length of interior channel 120, preferably comprising between about 4 inches and about 10 inches. Length of interior channel 120 preferably comprises about 5 inches, alternately preferably about 7 inches. Upon reading this specification, those skilled in the art will now appreciate that, under appropriate circumstances, considering such issues as cost, temperature differential, refrigerant, etc., other lengths may suffice.

Pre-injection chamber 122 preferably serves to provide an initial heat exchange between lower-temperature liquid refrigerant 136 and high-temperature vapor 140, preferably through the wall of interior channel 120 (at least embodying herein at least one heat exchanger structured and arranged to exchange heat between at least one cooling fluid and the at least one superheated refrigerant fluid, to decrease temperature differential between such at least one cooling fluid and such at least one superheated refrigerant fluid; and at least embodying herein heat exchanger means for exchanging heat between at least one cooling fluid and the at least one superheated refrigerant fluid, to decrease temperature differential between such at least one cooling fluid and the at least one superheated refrigerant fluid). The wall of interior channel 120 (at least embodying herein wherein at least one wall of said at least one suction creator comprises at least one separator structured and arranged to physically separate such at least one cooler fluid from the at least one superheated refrigerant fluid, while allowing exchange of heat in said at least one heat exchanger by transmitting heat through said at least one separator) preferably prevents the immediate mixing of lower-temperature liquid refrigerant 136 with high-temperature vapor 140, preferably allowing initial heat exchange to diminish the temperature variation between lower-temperature liquid refrigerant 136 and high-temperature vapor 140. This initial heat exchange preferably begins vaporization of lower-temperature liquid refrigerant 136, preferably prior to injection, preferably allowing rapid mixing, of lower-temperature liquid refrigerant 136 with high-temperature vapor 140 preferably without thermal shock (this arrangement at least embodying herein exchanging heat, in at least one heat exchanger, between at least one cooling fluid and the at least one superheated refrigerant fluid, to decrease temperature differential between such at least one cooling fluid and the at least one superheated refrigerant fluid).

At least two spacers 425 preferably axially center interior channel 120 inside interior passage 118, as shown. Spacers 425 preferably define spacing of internal pre-injection chamber 122, as shown. Spacer 425, near inlet side of hot-gas desuperheater fitting 104, preferably comprises at least one sealing spacer 426, as shown, preferably sealing against passage of high-temperature vapor 140 into internal pre-injection chamber 122, thereby preferably forcing flow of high-temperature vapor 140 into interior channel 120 (this arrangement at least herein embodying wherein the at least one superheated refrigerant fluid flows inside said at least one tube and such at least one cooler fluid may substantially surround the exterior perimeter of said at least one tube).

Spacer 425, near outlet side of hot-gas desuperheater fitting 104, as shown, preferably comprises at least one injection portal spacer 428, as shown, preferably allowing passage of lower-temperature liquid refrigerant 136 into interior passage 118 from internal pre-injection chamber 122 (this arrangement at least embodying herein injecting, using at least one injector, such at least one cooling fluid into the at least one superheated refrigerant fluid after the step of exchanging heat).

Pre-ejection chamber 122 preferably uniformly distributes the liquid refrigerant around interior channel 120 prior to downstream discharge into interior passage 118. In preferred operation, lower temperature liquid refrigerant 136 is passively suctioned from liquid runoff line 112, preferably through liquid refrigerant transfer line 114, and is preferably injected into discharge line 110 at hot-gas desuperheater fitting 104, as shown.

Low-pressure region 145 preferably forms, as shown, preferably at the exit of Venturi structure 150 due to the Venturi Effect (this arrangement at least embodying herein creating suction to draw such at least one cooling fluid into such at least one heat exchanger by decreasing localized pressure near such at least one injector). Lower-temperature liquid refrigerant 136 is preferably drawn, by low-pressure region 145, preferably from pre-injection chamber 122 into interior channel 120, preferably through at least one injection port 128 (at least herein embodying wherein said at least one injector comprises at least one injector port) preferably passing through injection portal spacer 428 (at least embodying herein at least one injector structured and arranged to inject such at least one cooling fluid into the at least one superheated refrigerant fluid after exchange of heat in said at least one heat exchanger; and at least embodying herein injector means for injecting such at least one cooling fluid into the at least one superheated refrigerant fluid after exchange of heat in said at least one heat exchanger) near the exit of interior channel 120, as shown. This arrangement at least herein embodies wherein said at least one suction creator assists injection by said at least one injector; and this arrangement at least embodies herein wherein such suction assists injection by such at least one injector; and this arrangement at least embodies herein wherein said suction creator means assists injection by said injector means.

Additionally, at least one mixing chamber 450 preferably uses turbulence, at the exit of interior channel 120, to inject lower-temperature liquid refrigerant 136 preferably around the entire circumference of interior passage 118 (this arrangement at least embodying herein mixing such injected cooling fluid and the at least one superheated refrigerant fluid to produce at least one desuperheated refrigerant fluid having at least one state substantially near at least one saturated state).

Figure 3:
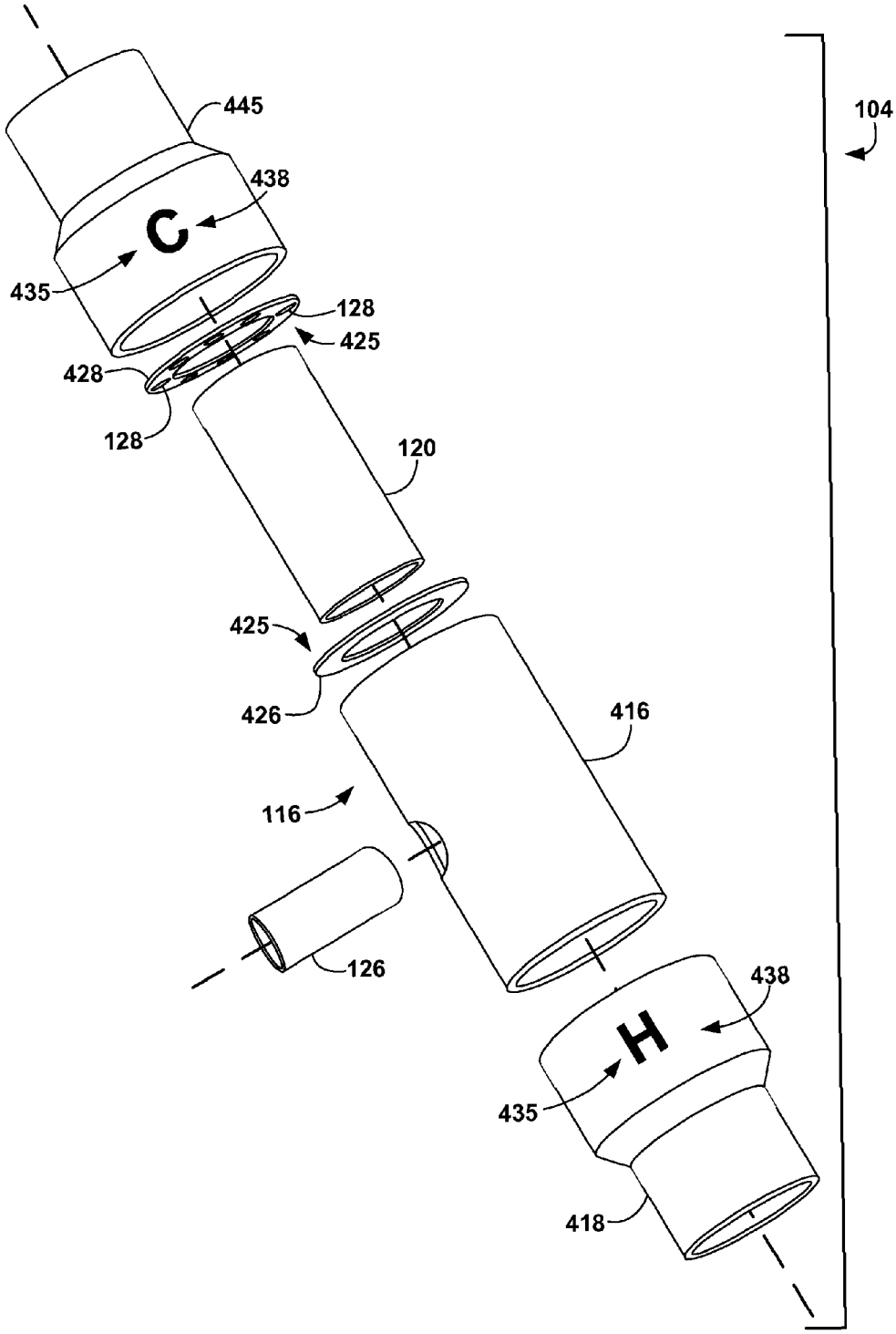
FIG. 3 shows an exploded view of the hot-gas desuperheater fitting of FIG. 2.

In the depicted preferred embodiment of the present invention, lower-temperature liquid refrigerant 136 injects through preferably about eight injection ports 128 (at least herein embodying wherein said at least one injector comprises a plurality of said at least one injector ports evenly spaced about the perimeter of the flow of the at least one superheated refrigerant fluid), preferably evenly spaced, arranged circumferentially about interior channel 120, as shown in FIG. 3, thus preferably maximizing mixing and preferably injection efficiency in mixing chamber 450 (at least embodying herein at least one fluid mixer structured and arranged to mix such injected cooling fluid and the at least one superheated refrigerant fluid to produce at least one desuperheated refrigerant fluid having at least one state substantially near at least one saturated state; and this arrangement at least embodying herein wherein said at least one injector injects such at least one cooler fluid into the at least one superheated refrigerant fluid substantially evenly around the perimeter of flow of the at least one superheated refrigerant fluid; and at least embodying herein fluid mixer means for mixing such injected cooling fluid and the at least one superheated refrigerant fluid to produce at least one desuperheated refrigerant fluid having at least one state substantially near at least one saturated state). As a result, high-temperature vapor 140, which had previously been above the saturation temperature (high-temperature superheated vapor 132), is preferably brought near to the saturation temperature (becoming high-temperature desuperheated vapor 134), as shown. Saturation temperature is the temperature at which a gas begins to condense into a liquid.

Hot-gas desuperheater fitting 104 is preferably atmosphere-tight bonded silver soldered to form an assembly, as shown. Further, hot-gas desuperheater fitting 104 is preferably atmosphere-tight bonded silver soldered to discharge line 110 and liquid refrigerant transfer line 114, when installed. Upon reading this specification, those skilled in the art will now appreciate that, under appropriate circumstances, considering such issues as future materials, thermal expansion variations, etc., other atmosphere tight bondings, may suffice.

Hot-gas desuperheater fitting 104 preferably is installed vertically with outlet-side coupler 445 higher in elevation than 418. This vertical arrangement preferably allows lower-temperature liquid 136 to preferably pool in internal pre-injection chamber 122, preferably allowing for the initial heat exchange prior to injection.

It is noted that hot-gas desuperheater circuit 102 preferably does not require a mechanical pump or gravity-assisted fluid pressure to operate. Rather, hot-gas desuperheater circuit 102 preferably uses the Venturi Effect to create suction. Further, hot-gas desuperheater circuit 102 preferably does not require injecting fluids from sources external to refrigeration cycle 101. Rather, hot-gas desuperheater circuit 102 preferably utilizes a portion of lower-temperature liquid refrigerant 136 already in refrigeration cycle 101, as shown.

Additionally, by using both the initial heat exchange and injecting lower-temperature liquid 136, less of lower-temperature liquid 136 is preferably needed to desuperheat high-temperature vapor 140. Since any amount of lower-temperature liquid 136 diverted from refrigeration cycle 101 results in reduced efficiency of refrigeration cycle 101, utilizing less of lower-temperature liquid 136 decreases loss of efficiency required to extend the life of condenser 108.

Also, applicant has determined, through testing, that temperatures of high-temperature superheated vapor 132 in refrigeration cycle 101, running about 190 degrees Fahrenheit, were reduced to about 90 degrees Fahrenheit in high-temperature desuperheated vapor 134.

Further, applicant has determined, through testing, that hot-gas desuperheater fitting 104 self-regulates the amount of lower-temperature liquid 136 injected based on the volume of high-temperature superheated vapor 132 flowing through hot-gas desuperheater fitting 104. When the flow volume of high-temperature superheated vapor 132 decreases the suction created by Venturi structure 150 likewise decreases drawing less of lower-temperature liquid 136 into internal pre-injection chamber 122. This behavior allows hot-gas desuperheater fitting 104 to adjust, in multi-loop heating systems, to changes in flow of high-temperature superheated vapor 132 caused by a loop shutting off or running in defrost mode. By self-regulating, high-temperature superheated vapor 132 is not over-cooled but maintains approximately the same cooling rate.

FIG. 3 shows an exploded view of hot-gas desuperheater fitting 104 of FIG. 2. As shown, intake-side coupler 418 and outlet-side coupler 445 preferably comprise diameter-reducing couplers sized to couple discharge line 110 and outer housing 416. Outer housing 416 (at least herein embodying wherein said at least one outer container is substantially cylindrical) preferably comprises at least one cylinder, preferably at least one section of pipe, comprising sizes as discussed in relation to FIG. 2. Likewise, interior channel 120 (at least herein embodying wherein said at least one suction creator comprises at least one tube; and at least embodying herein wherein said at least one suction creator is substantially cylindrical) and side inlet 126 preferably each comprise, as shown, at least one cylinder, preferably at least one section of pipe, comprising sizes as discussed in relation to FIG. 2. Intake-side coupler 418, outlet-side coupler 445 (at least embodying herein at least one discharge line adapter structured and arranged to adapt the perimeter of at least one discharge line, from at least one compressor, to the perimeter of said at least one outer container), outer housing 416 (at least embodying herein at least one outer container structured and arranged to contain such at least one cooler fluid substantially near said at least one separator), interior channel 120, and side inlet 126 preferably comprise metal, preferably copper. Upon reading this specification, those skilled in the art will now appreciate that, under appropriate circumstances, considering such issues as future materials, equipment integrated with, thermal expansion variations, etc., other materials, such as for example, ceremets, metal alloys, future plastics, other than copper metals, etc., may suffice.

Spacers 425 preferably comprise at least one ring preferably with at least one inner diameter substantially matching the outer diameter of interior channel 120 and at least one outer diameter preferably substantially matching interior diameter of outer housing 416, as shown. Injection portal spacer 428 preferably further comprises injection ports 128, preferably between about ⅛ inch and about ½ inch in diameter (at least herein embodying wherein the diameter of said at least one injector port comprises between about ⅛ inch and about ½ inch).

Diameter of injection ports 128 preferably comprises about ¼ inch (at least herein embodying wherein the diameter of said at least one injector port comprises about ¼ inch), alternately preferably about ⅜ inch (at least herein embodying wherein the diameter of said at least one injector port comprises about ⅜ inch).

Variation in diameter of injection ports 128 may preferably be used to control the rate of lower-temperature liquid 136 injected. Upon reading this specification, those skilled in the art will now appreciate that, under appropriate circumstances, considering such issues as fitting sizes, cost, flow rates, etc., other injection port diameters, may suffice.

In selecting the number and size of injection ports 128, the diameter of injection ports 128 times the number of injection ports 128 preferably comprises approximately the diameter of discharge line 110. Applicant has theorized that this relationship achieves optimal injection rates.

Spacers 425 preferably comprise metal, preferably brass. Upon reading this specification, those skilled in the art will now appreciate that, under appropriate circumstances, considering such issues as future materials, equipment integrated with, thermal expansion variations, etc., other materials, such as for example, ceremets, other than brass metal alloys, future plastics, other metals, etc., may suffice.

In order to make installation and use easier, intake-side coupler 418 and outlet-side coupler 445 preferably further comprise at least one temperature indicator 435, as shown, preferably indicia 438, preferably indicating the "hot" side and the "cool" side of hot-gas desuperheater fitting 104, preferably effectively indicating flow direction across hot-gas desuperheater fitting 104, as shown. Temperature indicator 435 preferably comprises at least one color indicator, preferably red on the "hot" side and blue on the "cool" side. For purposes of illustration, FIG. 3 denotes preferred such at least one color indicator with the characters "H" and "C", as shown. Upon reading this specification, those skilled in the art will now appreciate that, under appropriate circumstances, considering such issues as industry regulations, cost, manufacturing methods, etc., other temperature variation indicators, such as, for example, characters, symbols, graphics, color patterns, etc., may suffice.

Figure 4:
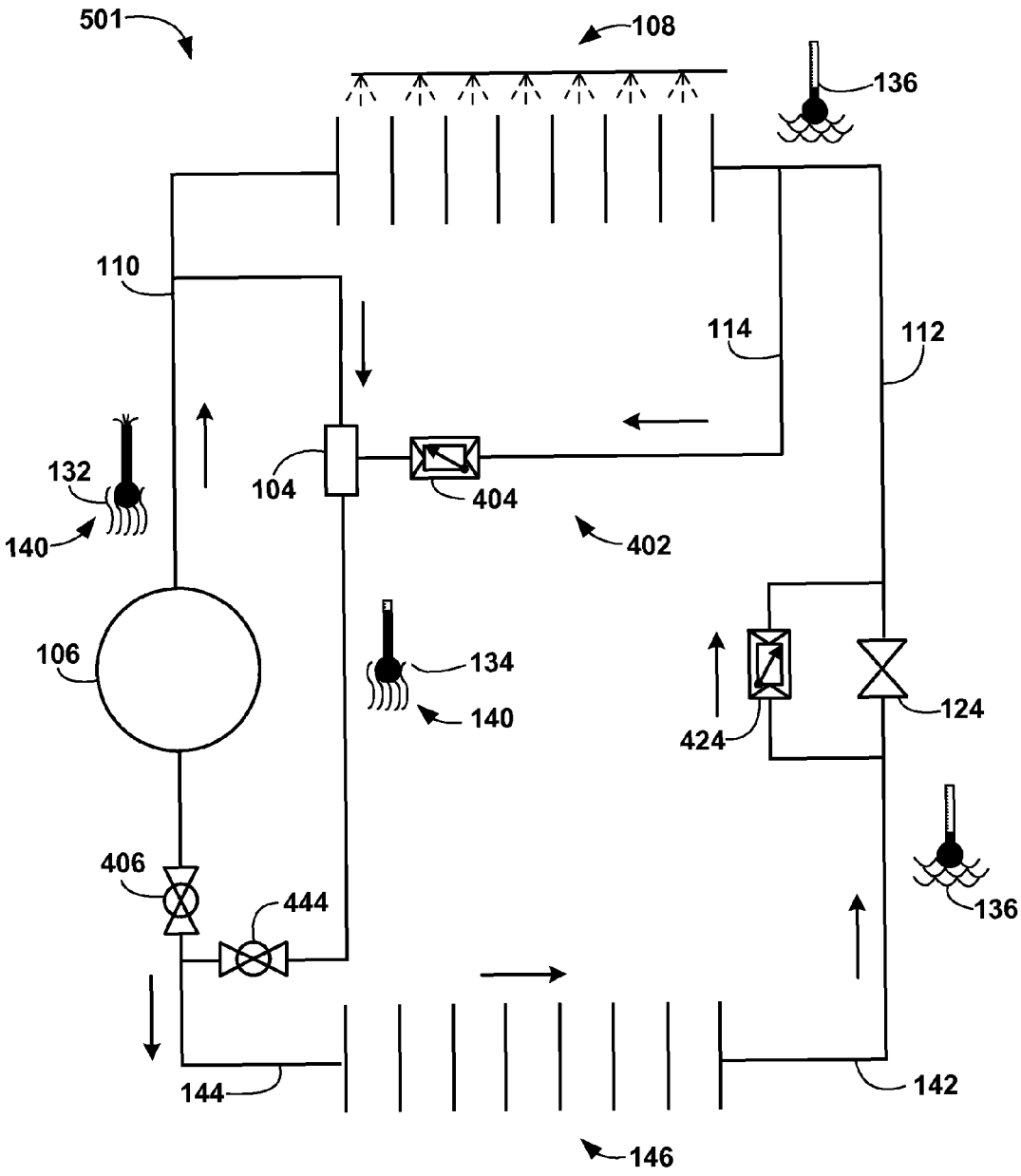
FIG. 4 shows a schematic diagram, illustrating the primary components of a refrigeration cycle utilizing at least one defrosting injection circuit, according to another preferred embodiment of the present invention.

FIG. 4 shows a schematic diagram illustrating the primary components of a refrigeration cycle 501 utilizing at least one defrosting injection circuit according to another preferred embodiment of the present invention. Although most features of hot-gas desuperheater circuit 402 are repeated from preferred hot-gas desuperheater circuit 102, in Hot-gas desuperheater circuit 402, rather than transferring high-temperature desuperheated vapor 134 to condenser 108, high-temperature desuperheated vapor 134 is preferably used to defrost evaporator 146, as shown.

Hot-gas desuperheater fitting 104 is preferably also useful in providing improved hot-gas defrosting, which may be used on a single or multiple evaporator system, and is particularly useful on multiplexed systems with evaporators at different temperatures. In this preferred embodiment, high-temperature vapor 140 is preferably routed to the outlet of evaporator 146, as shown. This preferably warms evaporator 146 to thaw any frost that has accumulated.

Defrost cycle 401 preferably uses at least one solenoid valve 406 and at least one solenoid valve 444 to reverse fluid flow across evaporator 146, as shown. Solenoid valve 444 preferably opens to allow flow of high-temperature vapor 140 to outlet-side of evaporator 146, while solenoid valve 406 preferably closes to prevent flow of high-temperature vapor 140 back into mechanical compressor 106. Likewise, at least one check valve 424 preferably bypasses expansion valve 124, as shown.

High-temperature vapor 140 preferably flows through evaporator 146, as shown, exchanging heat to defrost evaporator 146, and preferably condenses to form lower-temperature liquid 136. Lower-temperature liquid 136 preferably bypasses expansion valve 124, using check valve 424, and feeds back into liquid runoff line 112, as shown. By using hot-gas desuperheater fitting 104 in defrost cycle 401, thermal shock preferably is significantly reduced on evaporator 146, which preferably leads to a longer life of evaporator 146.

Figure 5:
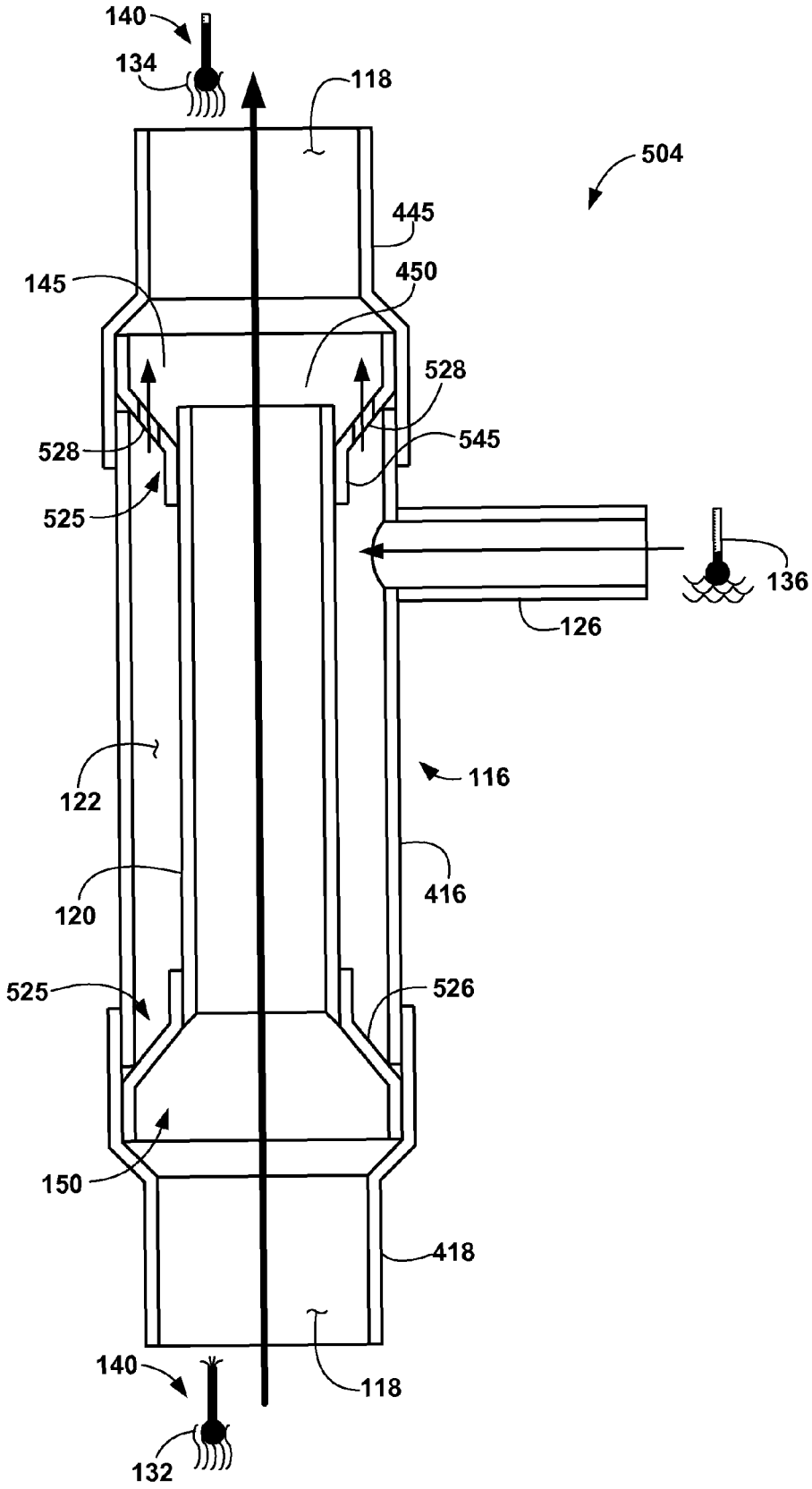
FIG. 5 shows a longitudinal cross-sectional view, through another hot-gas desuperheater fitting, according to an alternately preferred embodiment of the present invention.

FIG. 5 shows a longitudinal cross-sectional view through another hot-gas desuperheater fitting 504 according to an alternately preferred embodiment of the present invention. Although most features of hot-gas desuperheater fitting 504 are repeated from preferred hot-gas desuperheater fitting 104, in hot-gas desuperheater fitting 504, rather than spacers 425, at least two spacers 525 are preferably used to reduce the diameter, as shown. In use, hot-gas desuperheater fitting 504 preferably takes the place of hot-gas desuperheater fitting 104 in hot-gas desuperheater circuit 102 and hot-gas desuperheater circuit 402

Spacer 525 preferably comprises at least one diameter-reducing coupler, as shown. Spacer 525 preferably comprises metal, preferably copper. Upon reading this specification, those skilled in the art will now appreciate that, under appropriate circumstances, considering such issues as future materials, equipment integrated with, thermal expansion variations, etc., other materials, such as for example, ceremets, metal alloys, future plastics, other than copper metals, etc., may suffice.

Injection portal spacer 545, similarly to injection portal spacer 428, preferably comprises at least one injection port 528, preferably eight injection ports 528, preferably substantially similar to injection port 128 in size and distribution. Injection port 528 preferably is preferably positioned on beveled portion of injection portal spacer 545, as shown.

Sealing spacer 526, similarly to sealing spacer 426, preferably seals off internal pre-injection chamber 122 at inlet-side of interior channel 120. Sealing spacer 526, however, also provides a beveled entrance to interior channel 120 for flow of high-temperature vapor 140.

Figure 6:
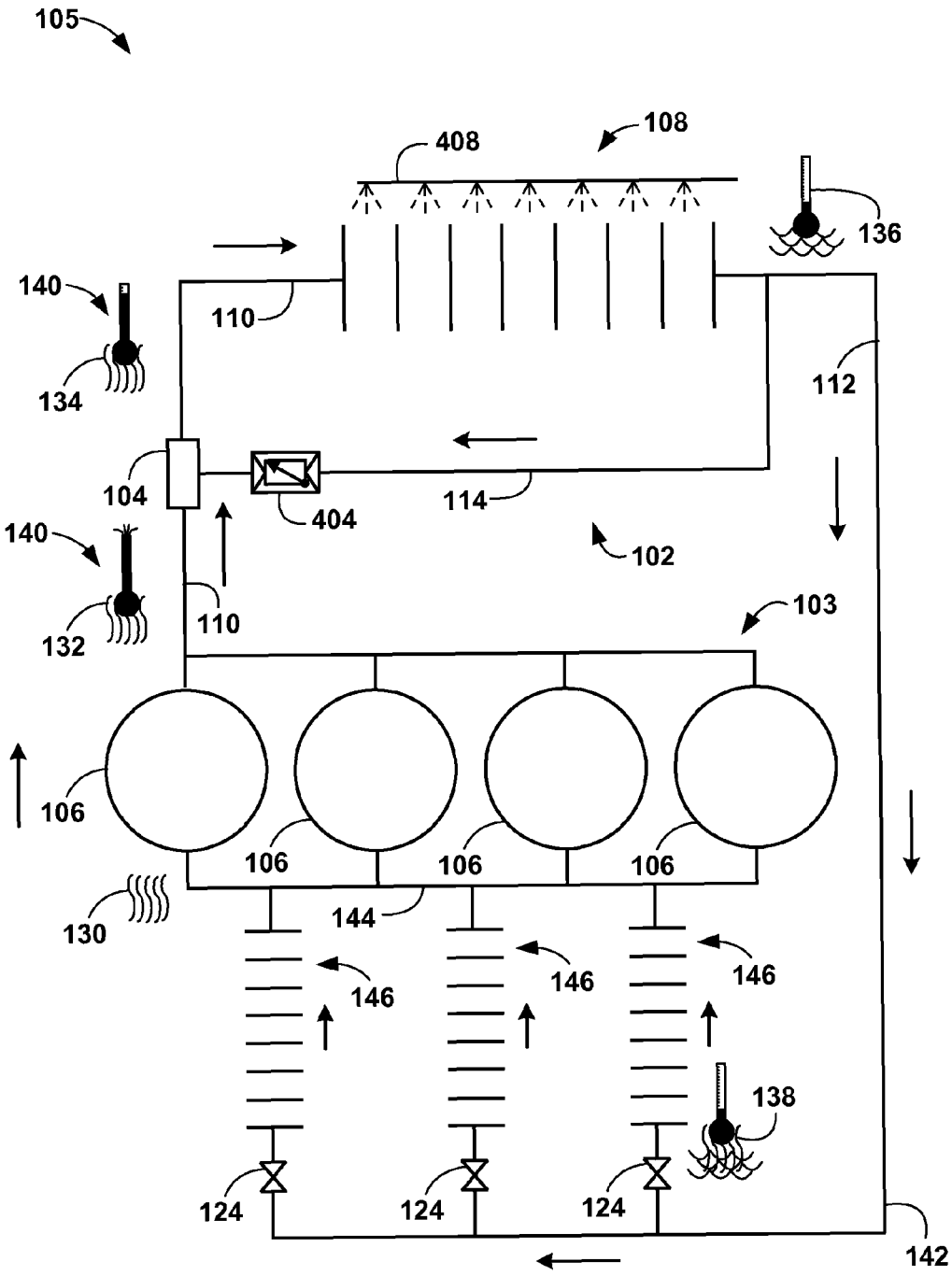
FIG. 6 shows a schematic diagram, illustrating a parallel compressor stack utilizing at least one hot-gas desuperheater circuit, according to a preferred embodiment of the present invention.

FIG. 6 shows a schematic diagram, illustrating a parallel compressor stack 103 utilizing hot-gas desuperheater circuit 102, according to a preferred embodiment of the present invention. Parallel compressor stack 103 preferably comprises multiple compressors 106 preferably connected in parallel, as shown. Using Parallel compressor stack 103 (at least embodying herein a plurality of parallel compressors) preferably allows a refrigeration cycle 105 to utilize multiple evaporators 146 (at least embodying herein a plurality of evaporators), as shown. In refrigeration cycle 105, desuperheater fitting 104 preferably is positioned between parallel compressor stack 103 and condenser 108, as shown, similar to refrigeration cycle 101.

Figure 7:
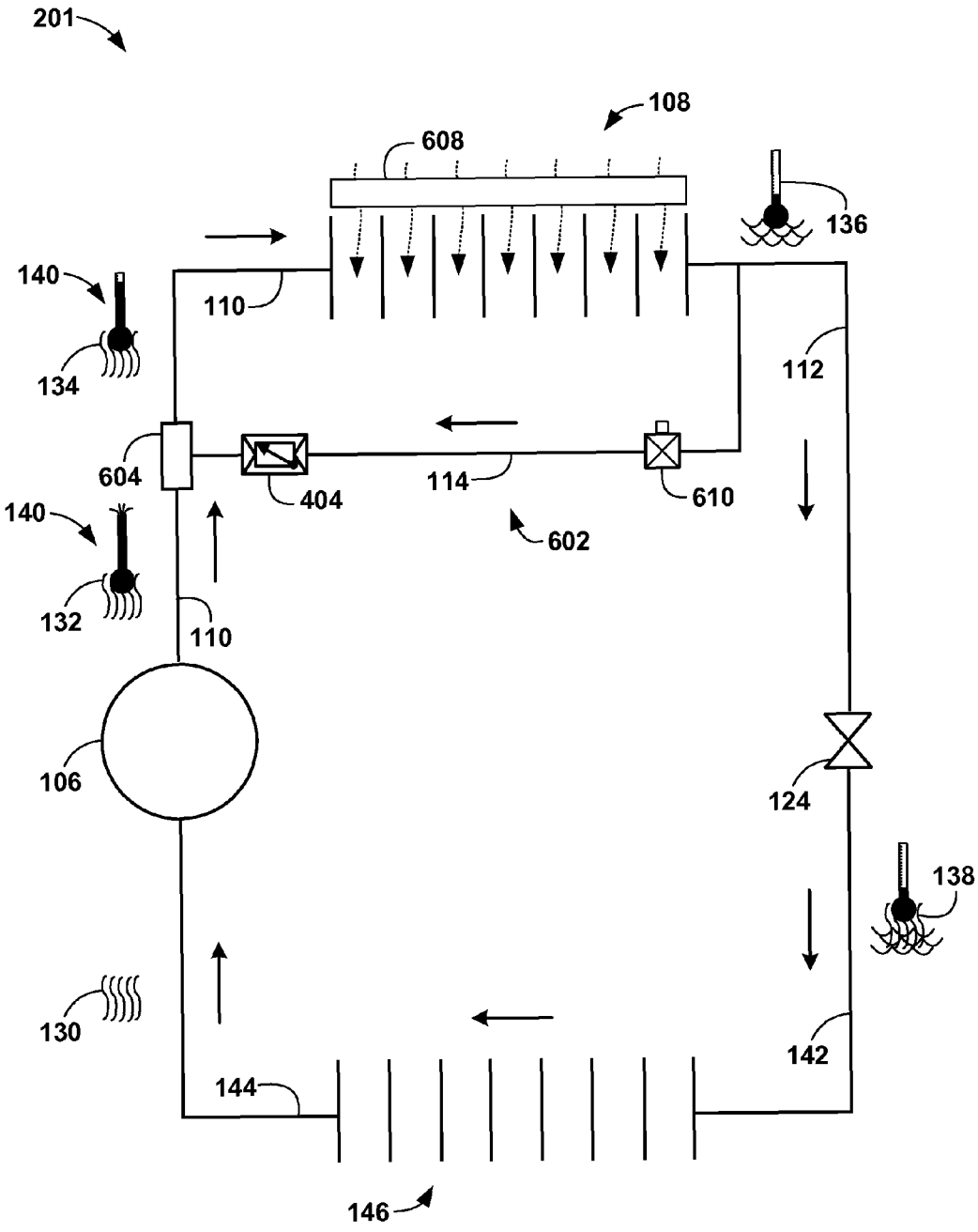
FIG. 7 shows a schematic diagram, illustrating another refrigeration cycle utilizing at least one hot-gas desuperheater circuit, according to a preferred embodiment of the present invention.

FIG. 7 shows a schematic diagram, illustrating another refrigeration cycle 201 utilizing at least one hot-gas desuperheater circuit 602, according to a preferred embodiment of the present invention. While many of the features of refrigeration cycle 201 are repeated from refrigeration cycle 101, in refrigeration cycle 201, condenser 108 preferably comprises at least one air cooled condenser 608 (at least herein embodying wherein said at least one condenser is air-cooled). Upon reading the teachings of this specification, those skilled in the art will now appreciate that, under appropriate circumstances, considering such issues as future technology, cost, etc., other condensers, such as, for example, thermo-electric condensers, thermal well condensers, passive condensers, etc., may suffice.

Refrigeration cycle 201 preferably comprises a residential air conditioning unit, alternately preferably a small scale commercial air conditioning unit. Additionally, refrigerant cycle 201 preferably comprises a heat pump (at least herein embodying wherein said at least one compressor, said at least one evaporator and said at least one condenser comprises at least one heat pump), as shown. Upon reading the teachings of this specification, those skilled in the art will now appreciate that, under appropriate circumstances, considering such issues as future technology, cost, etc., other applications of refrigerant cycle, such as, for example, single room units, temporary units, etc., may suffice. Upon reading the teachings of this specification, those skilled in the art will now appreciate that, under appropriate circumstances, considering such issues as cost, future technology, etc., other refrigerant cycle unit types, such as, for example, air conditioning only units, freezer units, etc., may suffice.

Further, in refrigeration cycle 201, hot-gas desuperheater circuit 602 repeats many features of hot-gas desuperheater circuit 102, however in hot-gas desuperheater circuit 602 is preferably scaled to fit refrigerant cycle 201. Desuperheater fitting 604 preferably comprises a scaled down version of desuperheater fitting 104. Such scaling down adjusts the size of desuperheater fitting 604 to fit the size of discharge line 110.

In addition, hot-gas desuperheater circuit 602 preferably comprises at least one solenoid valve 610. Solenoid valve 610 cuts off refrigerant flow in hot-gas desuperheater circuit 102 when refrigeration cycle 201 runs in reverse for heating.

Further, hot-gas desuperheater circuit 602 preferably is capable of retrofitting existing units using a refrigerant cycle, similar to refrigeration cycle 201 without hot-gas desuperheater circuit 602. Such a retrofit preferably increases efficiency and life of the existing unit, from hot-gas desuperheater circuit 602 preferably reducing shock to condenser 108, preferably providing refrigerant to condenser 108 at a more optimum operating temperature, and reducing the power draw do to work-load.

Figure 8:
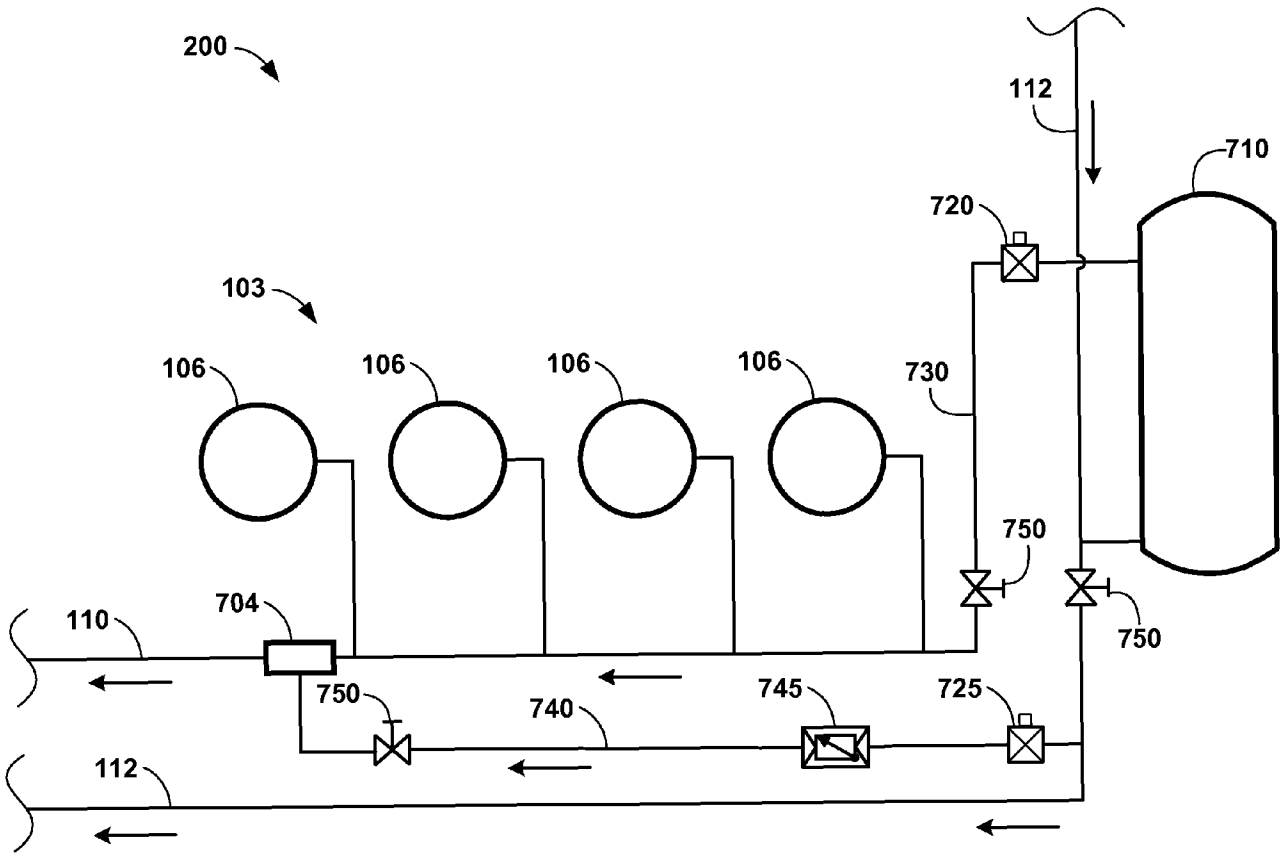
FIG. 8 shows a partial schematic diagram, illustrating at least one refrigerant reintroduction circuit, according to a preferred embodiment of the present invention.

FIG. 8 shows a partial schematic diagram, illustrating at least one refrigerant reintroduction circuit 200, according to a preferred embodiment of the present invention. In some refrigeration cycles similar to refrigeration cycle 105, at least one surge tank 710 is preferably added to refrigeration cycle 105. Surge tank 710 preferably collects excess refrigerant for temporary storage, particularly during defrost cycles when the pressure of refrigerant can increase. Surge tank 710 preferably provides space for the excess portions of refrigerant to be stored until the pressure of refrigerant reduces again. By providing surge tank 710 (at least embodying herein at least one refrigerant reserve storer structured and arranged to assist collecting excess portions of the at least one refrigerant out of the heat cycle circuit, relieving excess pressure, when pressure of the at least one refrigerant increases due to a defrost cycle) in refrigerant cycle 105, refrigerant cycle 105 preferably does not experience a critical-high-pressure situation.

When refrigeration cycle 105 returns to normal operation after a defrost cycle, refrigerant collected in surge tank 710 is preferably reintroduced through refrigerant reintroduction circuit 200 into discharge line 110. Refrigerant reintroduction circuit 200 preferably comprises at least one reintroduction fitting 704.

Reintroduction fitting 704 (at least embodying herein at least one refrigerant re-injector structured and arranged to assist re-injection of such excess portions of the at least one refrigerant from said at least one refrigerant reserve storer back into the heat cycle circuit, when pressure of the at least one refrigerant decreases after a defrost cycle) comprises hot-gas desuperheater fitting 104 applied in refrigeration cycle 105 to reintroduce refrigerant into discharge line 110 (at least herein embodying wherein said at least one refrigerant injector is located between said at least one compressor and said at least one condenser), as shown. Applicant has determined through testing that reintroduction of refrigerant into discharge line 110 reduces the load on compressors 106, which in turn reduces the power draw by compressors 106.

Refrigerant reintroduction circuit 200 preferably further comprises at least one vacuum relief line 730 and reintroduction line 740. At least one solenoid valve 725 preferably opens reintroduction line 740 when the pressure in refrigerant cycle 105 drops to a threshold indicating a need to reintroduce refrigerant into refrigerant cycle 105. At least one check valve 745 preferably prevents back flow of refrigerant in reintroduction line 740. Reintroduction fitting 704 preferably utilizes the Venturi effect from at least Venturi structure 150 to draw refrigerant from surge tank 710 and preferably reintroduce refrigerant into discharge line 110.

Vacuum relief line 730 is controlled by solenoid valve 720, preferably opening as refrigerant is drawn out of surge tank 710. Vacuum relief line 730 preferably connects between discharge line and surge tank 710, preferably allowing gas flow into surge tank 710 to replace refrigerant drawn out of surge tank 710. Refrigerant reintroduction circuit 200 preferably draws refrigerant out of surge tank at a rate of from 1 lb per minute to about 100 lb per minute, preferably about 40 lb per minute (at least herein embodying wherein said at least one refrigerant injector assists injection of the at least one refrigerant from said at least one refrigerant reserve storer at a rate from about 1 lb per minute to about 100 lb per minute; and at least herein embodying wherein said at least one refrigerant injector assists injection of the at least one refrigerant from said at least one refrigerant reserve storer at a rate of about 40 lb per minute). Applicant has determined through testing that refrigerant reintroduction circuit 200 drawing refrigerant out of surge tank at these rates significantly reduces reintroduction time, and thereby increasing the efficiency of refrigerant cycle 105, particularly following a defrost cycle. Upon reading the teachings of this specification, those skilled in the art will now appreciate that, under appropriate circumstances, considering such issues as future technology, cost, optimal efficiency, unit sizes, etc., other reintroduction rates, such as, for example, ½ lb per minute, 20 lb per minute, 150 lb per minute, etc., may suffice.

Refrigerant reintroduction circuit 200 preferably further comprises ball valves 750. Ball valves 750 preferably allow manual shutoff of refrigerant reintroduction circuit 200, preferably allowing maintenance.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, relating to cooling at least one superheated refrigerant fluid during at least one heat cycle, the system comprising:

a) at least one heat exchanger structured and arranged to exchange heat between at least one cooling fluid and the at least one superheated refrigerant fluid to decrease temperature differential between the at least one cooling fluid and the at least one superheated refrigerant fluid;

b) at least one injector, structured and arranged to inject the at least one cooling fluid into the at least one superheated refrigerant fluid after exchange of heat in said at least one heat exchanger; and c) at least one fluid mixer structured and arranged to mix the injected cooling fluid and the at least one superheated refrigerant fluid to produce at least one desuperheated refrigerant fluid having at least one state substantially near at least one saturated state;

d) wherein said at least one heat exchanger comprises at least one suction creator structured and arranged to create suction to draw the at least one cooling fluid into said at least one heat exchanger by decreasing localized pressure near said at least one injector;

e) wherein said at least one suction creator comprises at least one draw regulator structured and arranged to regulate the draw to prevent overcooling of the at least one superheated refrigerant fluid, when flow rate of the at least one superheated refrigerant fluid changes; and f) wherein said at least one suction creator assists injection by said at least one injector.

2. The system according to claim 1 wherein said at least one suction creator further comprises at least one separator structured and arranged to physically separate the at least one cooling fluid from the at least one superheated refrigerant fluid, while allowing exchange of heat in said at least one heat exchanger by transmitting heat through said at least one separator.

3. The system according to claim 2 wherein said at least one suction creator comprises at least one tube.

4. The system according to claim 3 wherein said at least one tube is structured and arranged to:

a) contain flow of the at least one superheated refrigerant fluid inside said at least one tube; and b) separate flow of the at least one cooling fluid substantially around at least one perimeter of said at least one tube.

5. The system according to claim 4 wherein said at least one injector is structured and arranged to inject the at least one cooling fluid into the at least one superheated refrigerant fluid substantially evenly around at least one perimeter of flow of the at least one superheated refrigerant fluid.

6. The system according to claim 4 wherein said at least one injector comprises at least one injector port.

7. The system according to claim 6 wherein said at least one injector comprises a plurality of said at least one injector ports evenly spaced about the perimeter of the flow of the at least one superheated refrigerant fluid.

8. The system according to claim 7 wherein, when connected to at least one discharge line, the diameter of said at least one injector port multiplied by the quantity of said plurality of said at least one injection ports comprises about the diameter of at least one discharge line.

9. The system according to claim 7 wherein the diameter of said at least one injector port comprises between about ⅛ inch and about ½ inch.

10. The system according to claim 9 wherein the diameter of said at least one injector port comprises about ⅜ inch.

11. The system according to claim 9 wherein the diameter of said at least one injector port comprises about ¼ inch.

12. The system according to claim 4 further comprising at least one outer container structured and arranged to contain the at least one cooling fluid substantially near said at least one separator.

13. The system according to claim 12 further comprising at least one discharge line structured and arranged to fit at least one discharge line.

14. The system according to claim 13 wherein said at least one suction creator is substantially cylindrical.

15. The system according to claim 13 wherein said at least one outer container is substantially cylindrical.

16. The system according to claim 15 wherein the difference between the diameter of the at least one discharge line and the diameter of said at least one suction creator comprises between about ½ inch and about ¼ inch.

17. The system according to claim 16 wherein the difference between the diameter of said at least one outer container and the diameter of said at least one suction creator comprises between about 2 inches and about 1 inch.

18. The system according to claim 17 wherein the diameter of said at least one outer container comprises about 2⅝ inches.

19. The system according to claim 18 wherein the diameter of the at least one discharge line comprises about ⅞ inches.

20. The system according to claim 19 wherein the diameter of said at least one suction creator comprises about ⅝ inches.

21. The system according to claim 18 wherein the diameter of the at least one discharge line comprises about 1⅛ inches.

22. The system according to claim 21 wherein the diameter of said at least one suction creator comprises about ⅞ inches.

23. The system according to claim 17 wherein the diameter of the at least one discharge line comprises about 1⅜ inches.

24. The system according to claim 23 wherein the diameter of said at least one suction creator comprises about 1⅛ inches.

25. The system according to claim 17 wherein the diameter of said at least one outer container comprises about 3⅛ inches.

26. The system according to claim 25 wherein the diameter of the at least one discharge line comprises about 1⅝ inches.

27. The system according to claim 26 wherein the diameter of said at least one suction creator comprises about 1⅜ inches.

28. The system according to claim 25 wherein the diameter of the at least one discharge line comprises about 2⅛ inches.

29. The system according to claim 28 wherein the diameter of said at least one suction creator comprises about 1⅝ inches.

30. The system according to claim 25 wherein the diameter of the at least one discharge line comprises about 2⅝ inches.

31. The system according to claim 30 wherein the diameter of said at least one suction creator comprises about 2⅛ inches.

32. The system according to claim 17 wherein the diameter of said at least one outer container comprises about 3⅝ inches.

33. The system according to claim 32 wherein the diameter of the at least one discharge line comprises about 3⅛ inches.

34. The system according to claim 33 wherein the diameter of said at least one suction creator comprises about 2⅝ inches.

35. The system according to claim 1 wherein said at least one injector comprises metal.

36. The system according to claim 35 wherein said at least one injector comprises brass.

37. The system according to claim 35 wherein said at least one injector comprises copper.

38. The system according to claim 1 wherein said at least one heat exchanger comprises metal.

39. The system according to claim 38 wherein said at least one heat exchanger comprises copper.

40. The system according to claim 1 further comprising:

a) at least one compressor;

b) at least one evaporator; and c) at least one condenser;

d) wherein said at least one injector is located between said at least one compressor and said at least one condenser.

41. The system according to claim 40 wherein said at least one condenser is water-cooled.

42. The system according to claim 40 wherein said at least one condenser is air-cooled.

43. The system according to claim 40 wherein said at least one compressor, said at least one evaporator and said at least one condenser comprises at least one heat pump.

44. The system according to claim 40 further comprising a plurality of parallel compressors.

45. The system according to claim 40 further comprising a plurality of evaporators.

46. A method, relating to cooling at least one superheated refrigerant fluid during at least one heat cycle, the method comprising the steps of:

a) exchanging heat, in at least one heat exchanger, between at least one cooling fluid and the at least one superheated refrigerant fluid to decrease temperature differential between the at least one cooling fluid and the at least one superheated refrigerant fluid;

b) injecting, using at least one injector, the at least one cooling fluid into the at least one superheated refrigerant fluid after the step of exchanging heat;

c) mixing the injected cooling fluid and the at least one superheated refrigerant fluid to produce at least one desuperheated refrigerant fluid having at least one state substantially near at least one saturated state;

d) creating suction to draw the at least one cooling fluid into the at least one heat exchanger by decreasing localized pressure near the at least one injector; and e) regulating the draw by flow rate of the at least one superheated refrigerant fluid;

f) wherein the regulating comprises preventing overcooling of the at least one superheated refrigerant fluid; and g) wherein the suction assists injection by the at least one injector.

47. A system, relating to cooling at least one superheated refrigerant during at least one heat cycle, the system comprising:

a) heat exchanger means for exchanging heat between at least one cooling fluid and the at least one superheated refrigerant fluid to decrease temperature differential between the at least one cooling fluid and the at least one superheated refrigerant fluid;

b) injector means for injecting the at least one cooling fluid into the at least one superheated refrigerant fluid after exchange of heat in said at least one heat exchanger;

c) fluid mixer means for mixing the injected cooling fluid and the at least one superheated refrigerant fluid to produce at least one desuperheated refrigerant fluid having at least one state substantially near at least one saturated state;

d) wherein said heat exchanger means comprises suction creator means for creating suction to draw the at least one cooling fluid into said heat exchanger means by decreasing localized pressure near said injector means;

e) wherein said suction creator means comprises draw regulator means for regulating the draw to prevent overcooling of the at least one superheated refrigerant fluid, when flow rate of the at least one superheated refrigerant fluid changes; and f) wherein said suction creator means assists injection by said injector means.

48. A system, relating to handling pressure changes of at least one refrigerant in a heat cycle circuit, comprising a) at least one compressor structured and arranged to assist compressing of the at least one refrigerant;

b) at least one evaporator structured and arranged to assist heat-collection by the at least one refrigerant;

c) at least one condenser structured and arranged to assist heat-rejection from the at least one refrigerant;

d) at least one refrigerant reserve storer structured and arranged to assist collecting excess portions of the at least one refrigerant out of the heat cycle circuit, relieving excess pressure, when pressure of the at least one refrigerant increases due to a defrost cycle; and e) at least one refrigerant re-injector structured and arranged to assist re-injection of the excess portions of the at least one refrigerant from said at least one refrigerant reserve storer back into the heat cycle circuit, when pressure of the at least one refrigerant decreases after a defrost cycle;

f) wherein said at least one refrigerant injector is located between said at least one compressor and said at least one condenser.

49. The system according to claim 48 wherein said at least one refrigerant injector assists injection of the at least one refrigerant from said at least one refrigerant reserve storer at a rate from about 1 lb per minute to about 100 lb per minute.

50. The system according to claim 49 wherein said at least one refrigerant injector assists injection of the at least one refrigerant from said at least one refrigerant reserve storer at a rate of about 40 lb per minute.

51. The system according to claim 48 wherein said at least one refrigerant injector comprises:

a) at least one heat exchanger structured and arranged to exchange heat between the at least one refrigerant coming from said at least one refrigerant reserve storer and the at least one refrigerant in the heat cycle circuit to decrease temperature differential between the at least one refrigerant coming from said at least one refrigerant reserve storer and the at least one refrigerant in the heat cycle circuit;

b) at least one injector, structured and arranged to inject the at least one refrigerant coming from said at least one refrigerant reserve storer into the at least one refrigerant in the heat cycle circuit after exchange of heat in said at least one heat exchanger; and c) at least one fluid mixer structured and arranged to mix the at least one refrigerant coming from said at least one refrigerant reserve storer and the at least one refrigerant in the heat cycle circuit to produce at least one thermally-mixed refrigerant fluid;

d) wherein said at least one heat exchanger comprises at least one suction creator structured and arranged to create suction to draw the at least one refrigerant coming from said at least one refrigerant reserve storer into said at least one heat exchanger by decreasing localized pressure near said at least one injector, and e) wherein said at least one suction creator assists injection by said at least one injector.

52. The system according to claim 51 wherein said at least one refrigerant injector assists injection of the at least one refrigerant from said at least one refrigerant reserve storer at a rate from about 1 lb per minute to about 100 lb per minute.

53. The system according to claim 52 wherein said at least one refrigerant injector assists injection of the at least one refrigerant from said at least one refrigerant reserve storer at a rate of about 40 lb per minute.

* * * * *